US008743046B2

(12) United States Patent
Kim

(10) Patent No.: US 8,743,046 B2
(45) Date of Patent: Jun. 3, 2014

(54) DEVICE AND METHOD FOR DRIVING LIQUID CRYSTAL DISPLAY DEVICE

(75) Inventor: Se-Young Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 442 days.

(21) Appl. No.: 12/904,004

(22) Filed: Oct. 13, 2010

(65) Prior Publication Data

US 2011/0090262 A1 Apr. 21, 2011

(30) Foreign Application Priority Data

Oct. 20, 2009 (KR) ..... 10-2009-0099734

(51) Int. Cl.
*G09G 3/36* (2006.01)

(52) U.S. Cl.
USPC ..... 345/102; 345/89; 345/690

(58) Field of Classification Search
USPC ..... 345/87–104, 204, 690
See application file for complete search history.

(56) References Cited

U.S. PATENT DOCUMENTS

| | | | | |
|---|---|---|---|---|
| 8,294,738 | B2 * | 10/2012 | Ahn | 345/690 |
| 2002/0063666 | A1 * | 5/2002 | Kang et al. | 345/87 |
| 2005/0140640 | A1 | 6/2005 | Oh et al. | |
| 2006/0044321 | A1 * | 3/2006 | Kang et al. | 345/589 |
| 2006/0290648 | A1 * | 12/2006 | Yun et al. | 345/102 |
| 2007/0268242 | A1 | 11/2007 | Baba et al. | |
| 2008/0218468 | A1 | 9/2008 | Kim et al. | |
| 2009/0066632 | A1 | 3/2009 | Chen | |

FOREIGN PATENT DOCUMENTS

| | | | |
|---|---|---|---|
| CN | 101388183 | A | 3/2009 |
| JP | 2007-310232 | A | 11/2007 |

* cited by examiner

*Primary Examiner* — Stephen Sherman
(74) *Attorney, Agent, or Firm* — Birch, Stewart, Kolasch & Birch, LLP

(57) ABSTRACT

The present invention relates to device and method for driving a liquid crystal display device which can prevent defective picture display coming from variation of a color temperature from taking place for improving a picture quality and reducing power consumption.

10 Claims, 5 Drawing Sheets

DEVICE AND METHOD FOR DRIVING LIQUID CRYSTAL DISPLAY DEVICE

CROSS REFERENCE TO RELATED APPLICATION

This application claims the benefit of the Korean Patent Application No. 10-2009-0099734, filed on Oct. 20, 2009, which is hereby incorporated by reference as if fully set forth herein.

BACKGROUND OF THE DISCLOSURE

1. Field of the Disclosure

The present invention relates to liquid crystal display devices, and more particularly, to device and method for driving a liquid crystal display device which can prevent defective picture display coming from variation of a color temperature from taking place for improving a picture quality and reducing power consumption.

2. Discussion of the Related Art

In flat display devices on the rise recently, there are liquid crystal display devices, field emission display devices, plasma display panel, light emitting display devices, and so on.

Of the flat display devices, the liquid crystal display devices, having excellent resolution, color display and picture quality, are applied to notebook computers, desk top monitors, and mobile terminals, actively.

The liquid crystal display device displays a picture by controlling light transmissivity of liquid crystals by using an electric field. To do this, the liquid crystal display device is provided with a liquid crystal panel for displaying the picture with a plurality of liquid crystal cells, a driving circuit for driving the liquid crystal panel, and a back light unit for directing a light to the liquid crystal panel.

The liquid crystal panel controls the transmissivity of the light from the back light unit for displaying a desired picture. In this instance, the back light unit drives a plurality of lamps of the back light unit in response to a lamp driving control signal from the driving circuit for supplying the light to the liquid crystal panel.

However, because the back light unit emits the light at fixed brightness always regardless of the picture signal to the liquid crystal panel, the back light unit has a problem in that power consumption thereof is high. Consequently, in the related art, though a method is suggested, in which a driving time period of the back light unit is reduced for reducing the power consumption, a further problem takes place, in which the brightness of a displayed picture becomes poor.

SUMMARY OF THE DISCLOSURE

Accordingly, the present invention is directed to device and method for driving a liquid crystal display device.

An object of the present invention is to provide device and method for driving a liquid crystal display device which can prevent display of a defective picture coming from variation of a color temperature from taking place for improving a picture quality and reducing power consumption.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a device for driving a liquid crystal display device includes a liquid crystal panel having a plurality pixel regions formed thereon, gate and data drivers for driving gate and the data lines on the liquid crystal panel, a timing controller for aligning and forwarding external picture data suitable for driving the liquid crystal panel and controlling the gate and data drivers, a picture converting unit for generating a dimming control signal by setting at least one reference gray scale level according to a color temperature change characteristic and changing a duty ratio according to the at least one reference gray scale level set thus, changing gray scale values of the picture data aligned thus and forwarding the picture data having the gray scale values changed thus to the data driver, and a back light unit for directing a light to the liquid crystal panel in response to the dimming control signal.

The picture converting unit includes a gray scale analyzing unit for detecting the gray scale values of the picture data aligned thus in at least one horizontal line or frame to detect gray scale information on at least one of the greatest, the smallest, the most frequent, or an average gray scale value, a dimming control unit for comparing a range of the gray scale set by the reference gray scale levels to the gray scale information detected thus, and changing the duty ratio according to a result of the comparison to generate the dimming control signal, and a gray scale modulation unit for comparing the gray scale range of the reference gray scale levels set thus to the picture data aligned and received thus, according to a result of the comparison, setting change widths of the gray scale values different from one another, or replace the gray scale values with preset gray scale values, for making the gray scale values of the picture data to be changed to have extended widths the same or different from one another.

The gray scale analyzing unit detects the gray scales of the picture data aligned thus in at least one horizontal line or frame, produces a histogram of the gray scales detected in at least one horizontal line or frame, and detects the gray scale information on at least one of the greatest, the smallest, the most frequent, or the average gray scale from the histogram.

The gray scale modulation unit, sets a conversion ratio such that a first gray scale level set smaller than a greatest gray scale level is a greatest gray scale value of the gray scale values of the picture data aligned thus if the gray scale values of the picture data aligned thus are within a range of a smallest gray scale level to a first reference gray scale level in the reference gray scale levels, sets the conversion ratio such that all of the gray scale values of the picture data are converted into a level identical to the first gray scale level if the gray scale values of the picture data aligned thus are within a range greater than the first reference gray scale level to smaller than the reference second gray scale level, and sets the conversion ratio such that the greatest gray scale level becomes the greatest gray scale value of the picture data aligned thus if the gray scale values of the picture data aligned thus are within a range of the second reference gray scale level to the greatest gray scale level.

The dimming control unit generates the dimming control signal such that a first duty ratio which is smaller than the 100% duty ratio is maintained if the gray scale information is within a range of the smallest gray scale level to the first reference gray scale level, the duty ratio increases gradually up to 100% duty ratio at the maximum if the gray scale information is within a range greater than the first reference gray scale level and smaller than the second reference gray scale level, and the duty ratio is fixed at 100% duty ratio at the maximum if the gray scale information is within a range from the second reference gray scale level to the greatest gray scale level.

In another aspect of the present invention, a method for driving a liquid crystal display device having gate and data drivers for driving gate and the data lines on a liquid crystal panel and a timing controller for aligning and forwarding external picture data suitable for driving the liquid crystal panel, includes the steps of generating a dimming control signal by setting at least one reference gray scale level according to a color temperature change characteristic and changing a duty ratio according to the at least one reference gray scale level set thus, and changing gray scale values of the picture data aligned thus and forwarding the picture data having the gray scale values changed thus to the data driver, and directing a light to the liquid crystal panel in response to the dimming control signal.

The step of generating a dimming control signal and changing gray scale values of the picture data aligned thus includes the steps of detecting the gray scale values of the picture data aligned thus in at least one horizontal line or frame to detect gray scale information on at least one of the greatest, the smallest, the most frequent, or an average gray scale value, comparing a range of the gray scale set by the reference gray scale levels to the gray scale information detected thus, and changing the duty ratio according to a result of the comparison to generate the dimming control signal, and comparing the gray scale range of the reference gray scale levels set thus to the picture data aligned and received thus, according to a result of the comparison, setting change widths of the gray scale values different from one another, or replace the gray scale values with preset gray scale values, for making the gray scale values of the picture data to be changed to have extended widths the same or different from one another.

The step of detecting gray scale information includes the steps of detecting the gray scales of the picture data aligned thus in at least one horizontal line or frame, producing a histogram of the gray scales detected in at least one horizontal line or frame, and detecting the gray scale information on at least one of the greatest, the smallest, the most frequent, or the average gray scale from the histogram.

The step of changing gray scale values of the picture data aligned thus includes the steps of setting a conversion ratio such that a first gray scale level set smaller than a greatest gray scale level is a greatest gray scale value of the gray scale values of the picture data aligned thus if the gray scale values of the picture data aligned thus are within a range of a smallest gray scale level to a first reference gray scale level in the reference gray scale levels, setting the conversion ratio such that all of the gray scale values of the picture data are converted into a level identical to the first gray scale level if the gray scale values of the picture data aligned thus are within a range greater than the first reference gray scale level to smaller than the reference second gray scale level, and setting the conversion ratio such that the greatest gray scale level becomes the greatest gray scale value of the picture data aligned thus if the gray scale values of the picture data aligned thus are within a range of the second reference gray scale level to the greatest gray scale level.

The step of producing a dimming control signal includes the step of generating the dimming control signal such that a first duty ratio which is smaller than the 100% duty ratio is maintained if the gray scale information is within a range of the smallest gray scale level to the first reference gray scale level, the duty ratio increases gradually up to 100% duty ratio at the maximum if the gray scale information is within a range greater than the first reference gray scale level and smaller than the second reference gray scale level, and the duty ratio is fixed at 100% duty ratio at the maximum if the gray scale information is within a range from the second reference gray scale level to the greatest gray scale level.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
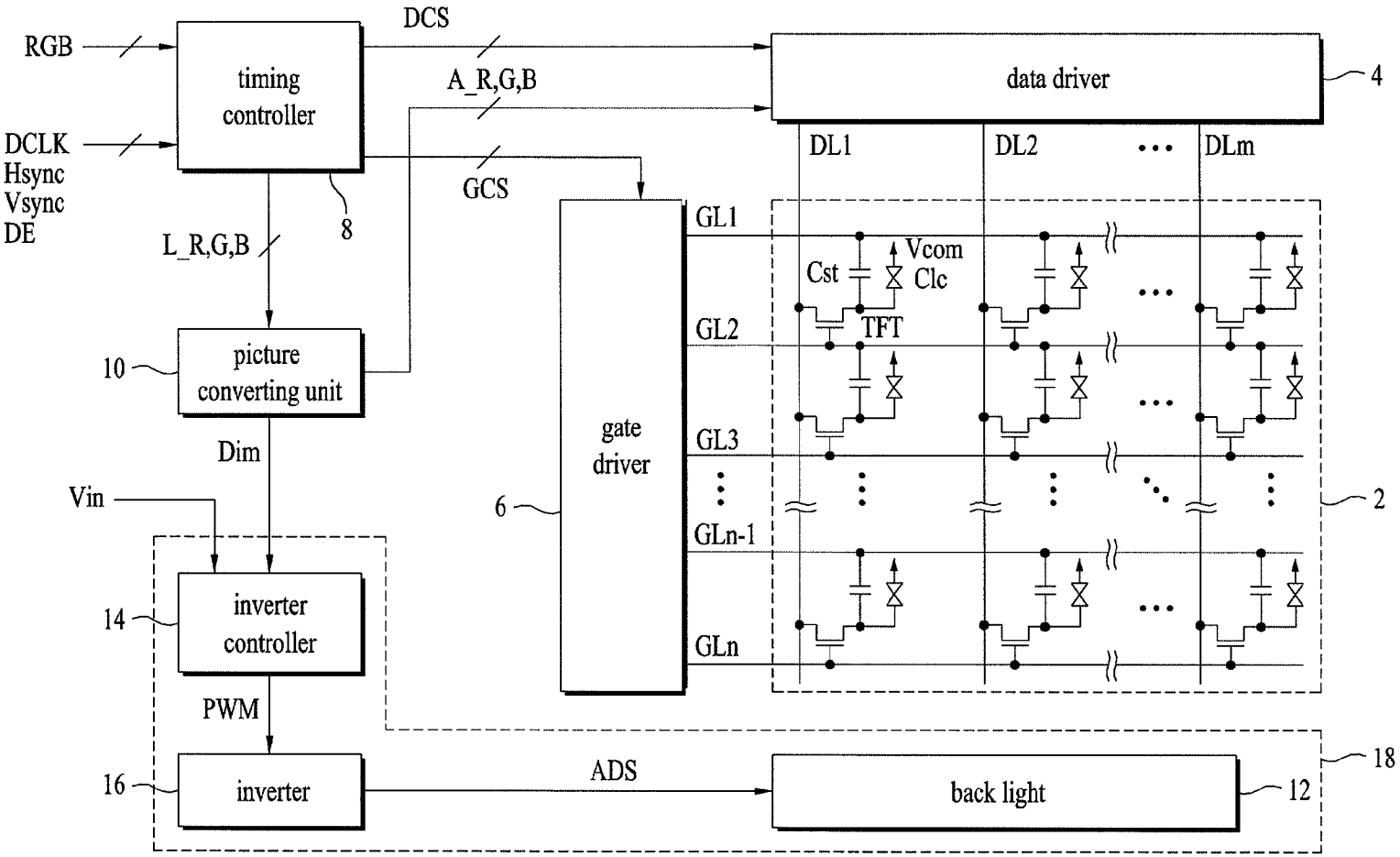
FIG. 1 illustrates a circuit diagram of a driving unit of a liquid crystal display device in accordance with a preferred embodiment of the present invention.

FIG. 1 illustrates a circuit diagram of a driving unit of a liquid crystal display device in accordance with a preferred embodiment of the present invention.

Referring to FIG. 1, the liquid crystal display device includes a liquid crystal panel 2 having a plurality of pixel regions, a data driver 4 for driving a plurality of data lines DL1 to DLm, a gate driver 6 for driving a plurality of gate lines GL1 to GLn, a timing controller 8 for aligning an external picture data RGB suitable for driving the liquid crystal panel 2, a picture converting unit 10 for setting at least one reference gray scale level according to a color temperature variation characteristic, and varying a duty ratio with the at least one reference gray scale level set thus for generating a dimming control signal Dim and converting gray scale values of the picture data L_R,G,B aligned thus and supplying the gray scale values to the data driver 4, and a back light unit 18 for directing a light to the liquid crystal panel 2 in response to the dimming control signal Dim.

The liquid crystal panel 2 has a thin film transistor TFT formed at each pixel region defined by the plurality of gate lines GL1 to GLn and data lines DL1 to DLm, and a liquid crystal capacitor Clc connected to the thin film transistor TFT. The liquid crystal capacitor Clc has a pixel electrode connected to the thin film transistor TFT, and a common electrode facing the pixel electrode with liquid crystals disposed therebetween. The thin film transistors TFT supply the picture signals from the data lines DL1 to DLm to the pixel electrodes in response to scan pulses from the gate lines GL1 to GLn, respectively. The liquid crystal capacitor Clc has a voltage difference of the picture signal supplied to the pixel electrode and a common voltage supplied to the common electrode charged thereto, and varies arrangement of liquid crystal molecules with the voltage difference to control the light transmissivity for producing the gray scale. And, the liquid crystal capacitor Clc has a storage capacitor Cst connected parallel thereto for sustaining the voltage charged at the liquid crystal capacitor Clc until supply of a next data signal. The storage capacitor Cst is formed overlapped with the pixel electrode with a prior gate line and an insulating film disposed therebetween. Different from this, the storage capacitor Cst is formed overlapped with the storage line and the insulating film disposed therebetween.

The data driver 4 converts the picture data A_R,G,B converted at the picture converting unit 10 into an analog picture data, i.e., a picture signal by using a source start pulse SSP, and a source shift clock SSC of data control signals DCS from the timing controller 8, and supplies one horizontal line portion of the picture signal to the data lines DL1 to DLm at every horizontal period in which the scan pulse is supplied to the gate lines GL1 to GLn. In this instance, the data driver 4 supplies the picture signal to the data lines DL1 to DLm in response to a source output enable SOE signal. In detail, the data driver 4 latches the RGB data A_R,G,B received in response to the SSC and supplies the one horizontal line portion of the picture signal to the data lines DL1 to DLm at every horizontal period in which the scan pulse is supplied to the gate lines GL1 to GLn in response to the SOE signal.

The gate driver 6 generates gate on signals in succession in response to gate control signals GSC from the timing controller 8, for an example, a gate start pulse GSP, a gate shift clock GSC, controls a pulse width of the gate on signal in response to the gate output enable GOE signal, and supplies the gate on signals to the gate lines GL1 to GLn in succession. In this instance, in a period when no gate on voltages are supplied to the gate lines GL1 to GLn, gate off voltages are supplied.

The timing controller 8 aligns the external picture data RGB suitable for driving the liquid crystal panel, and supplies the picture data L_R,G,G aligned thus to the picture converting unit 10. The timing controller 8 also generates a gate control signal GCS and a data control signal DCS for controlling gate a driver and a data driver 4 and 6 by using one of external synchronizing signals, i.e., a dot clock DCLK, a data enable signal DE, horizontal and vertical synchronizing signals Hsync and Vsync.

Of entire gray scale levels of the picture data RGB, the picture converting unit 8 sets at least one reference gray scale level, for an example, a first reference gray scale level and a second gray scale level at which the color temperature characteristic changes significantly, varies the duty ratio according to the reference gray scale levels set thus to generate a dimming control signal Dim, and supplies the dimming control signal having the duty ratio varied thus to the back light unit 18 for controlling a time period the light is directed to the liquid crystal panel 2. In this instance, the color temperature of the picture displayed on the liquid crystal panel can vary with the period the light is directed to the liquid crystal panel 2. Accordingly, it is required for the picture converting unit 10 to control the period the light is directed to the liquid crystal panel 2 such that a ratio of change of the color temperature characteristic becomes minimum regardless of the brightness change of the display picture. Therefore, the picture converting unit 10 sets the gray scale levels at which the color temperature characteristic changes significantly as the reference gray scale levels respectively, changes the duty ratio according to the reference gray scale levels respectively, and generates the dimming control signal Dim for minimizing the color temperature characteristic.

The picture converting unit 10 also increases the gray values of the picture data L_R,G,B aligned thus from the timing controller 8 by widths different from one another according to the reference gray scale levels set thus. That is, the picture converting unit 10 sets extension widths of the gray scale values of the picture data L_R,G,B differently according to the first and second gray scale levels set thus, or changes the gray scale values of the picture data L_R,G,B to preset gray scale values in package for changing the gray scale values of the picture data L_R,G,B to have widths different from one another depending on ranges. Thus, the picture converting unit 10 extends the gray scale values of the picture data L_R,G,B to have widths different one another according to the reference gray scale levels, i.e., the first and the second reference gray scale levels and supplies to the data driver 4. Owing to this, the brightness and the contrast ratio of the picture displayed on the liquid crystal panel 2 can be extended.

The picture converting unit 10 will be described in detail later with reference to the attached drawings. Though only a case is described in which the picture converting unit 10 is provided on an outside of the timing controller 8 for convenience's sake, the picture converting unit 10 may be built in the timing controller 8.

The back light 18 includes a back light 12 having a plurality of light sources for directing the light to the liquid crystal panel 2 and an optical unit for improving efficiency of the light from the light sources, an inverter controller 14 for forwarding pulse width modulation PWM signals in response to the dimming control signal Dim converted thus from the picture converting unit 10, and an inverter 16 for generating an alternative current driving signal ADS for driving the light sources in response to the PWM signal and supplying the ADS to the plurality of light sources.

In this instance, as the light source of the back light 12, cylindrical lamps, such as CCFL (Cold Fluorescent Lamp), EEFL (External Electrode Fluorescent Lamp), are used, mostly. The lamps emit the light driven by the ADS signal from the inverter 16. For an example, a scanning back light unit 18 emits the light by turning on/off the plurality of cylindrical lamps in succession. Along with this, the optical unit diffuses and converges the light from the light sources for improving light efficiency.

The inverter controller 14 generates the PWM signal in correspondence to the dimming control signal having a converted duty ratio from the picture converting unit 10 and supplies the PWM signal to the inverter 16. In this instance, since there may be a plurality of inverters 16 to match to a number of the lamps, the PWM signal can be supplied to the plurality of inverters 16 in succession or at a time. The PWM signal is a signal having turn on/off period varied with the duty ratio of the converted dimming control signal Dim. That is, the PWM signal can be a signal which is a lamp turn on/off period, for an example, high/low period, varied with the duty ratio of the dimming control signal Dim.

The inverter 16 generates the ADS for driving the lamp in a burst mode in which the inverter 16 turns on/off the lamp by making the ADS to be supplied or cut off according to the PWM signal from the inverter controller 14.

Figure 2:
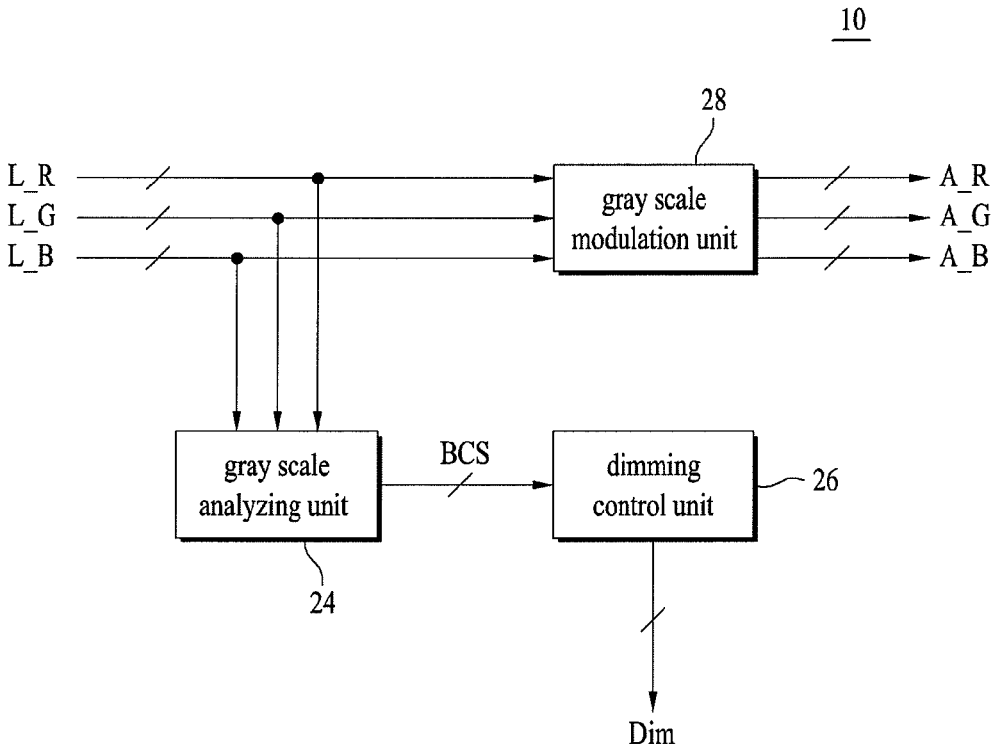
FIG. 2 illustrates circuit diagram of the picture converting unit in FIG. 1 in accordance with a preferred embodiment of the present invention.

FIG. 2 illustrates circuit diagram of the picture converting unit in FIG. 1 in accordance with a preferred embodiment of the present invention.

Referring to FIG. 2, the picture converting unit 10 includes a gray scale analyzing unit 24 for detecting the gray scale values of the picture data L_R,G,B aligned thus from the timing controller 8 in at least one horizontal line or frame and detecting gray scale information BCS on at least one of the greatest, the smallest, the most frequent, or average gray scale value, a dimming control unit 26 for comparing a range of the gray scale set by the reference gray scale levels to the gray scale information BCS detected thus, and changing the duty ratio according to a result of the comparison for generating the dimming control signal Dim, and a gray scale modulation unit 28 for comparing the gray scale range according to the reference gray scale levels set thus to the picture data L_R, G,B aligned and received thus, sets the change widths of gray scale value different from one another according to a result of the comparison, or replace the gray scale values with preset gray scale values, for making the gray scale values of the picture data L_R,G,B to be changed to have extension widths the same or different from one another.

Moreover, the picture converting unit 10 has a delay unit (not shown) additionally for supplying the picture data L_R, G,B aligned thus from the timing controller 8 to the gray scale modulating unit 28 after delaying the picture data L_R,G,B while a period in which the gray scale analyzing unit 24 detects the gray scale information BSC by at least one horizontal line or frame.

The gray scale analyzing unit 24 detects the gray scales of the picture data L_R,G,B aligned thus from the timing controller 8 in at least one horizontal line or frame, and produces a histogram of the gray scales detected by at least one horizontal line or frame, and detects the gray scale information BCS on at least one of the greatest, the smallest, the most frequent, or average gray scale from the histogram and forwards the detected gray scales to the dimming control unit 26.

The dimming control unit 26 receives duty ratio information matched to the gray scale information BCS detected thus through at least one memory (not shown) or the like, and generates and forwards the dimming control signal Dim to be matched to the duty ratio information received thus.

In detail, the duty ratio information stored in the memory or the like can be set differently depending on whether the gray scale information detected thus falls on a gray scale range smaller than the first and second reference gray scale levels set thus, between the first and second reference gray scale levels set thus, or greater than the first and second reference gray scale levels set thus. Particularly, of entire gray scale levels of the picture data RGB, since the first and second reference gray scale levels are set to be gray scale levels at which the color temperature characteristic changes significantly respectively, the color temperature change can be made minimum by varying the duty ratio depending on the range of the gray scale information BCS detected thus. Detailed operation of the dimming control unit 26 will be described with reference to the attached drawings.

The gray scale modulation unit 28 receives and forwards converted gray scale data A_R,G,B respectively corresponding to the picture data L_R,G,B from the timing controller 8 by using the memory. In detail, the memory or the like has the converted gray scale data A_R,G,B stored therein for increasing the gray scale values of the aligned picture data L_R,G,B by widths different from one another according to the first and second reference gray scale levels. By using this, the gray scale modulation unit 28 sets conversion widths of the gray scales of the picture data L_R,G,B different from one another according to the first and second reference gray scale levels, or replaces the gray scales with preset gray scale values, for converting the gray scale values of the aligned conversion gray scale data A_R,G,B by different widths.

Figure 3A:
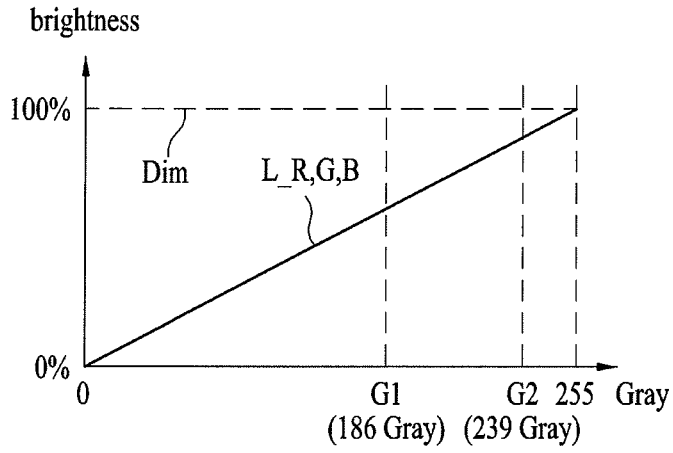
FIG. 3A illustrates a graph showing a relation between an input picture data and a dimming control signal.
Figure 3B:
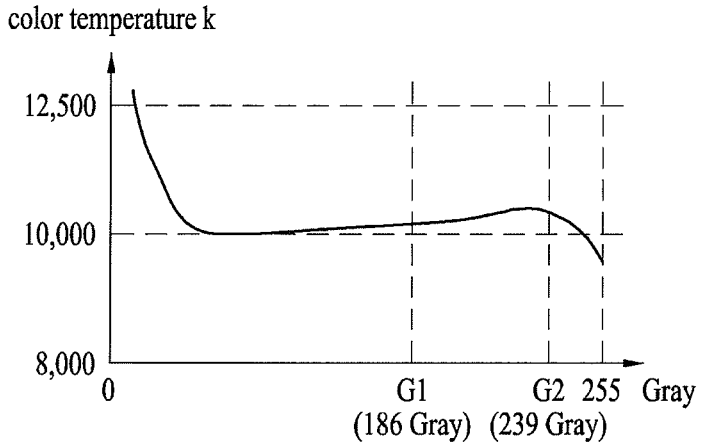
FIG. 3B illustrates a graph showing color temperature variation with the input picture data and the dimming control signal in FIG. 3A.

FIG. 3A illustrates a graph showing a relation between an input picture data and a dimming control signal, and FIG. 3B illustrates a graph showing color temperature variation with the input picture data and the dimming control signal in FIG. 3A.

Particularly, FIG. 3A illustrates a case when the duty ratio of the dimming control signal Dim is made to be maintained 100% in a related art state in which the gray scales of the picture data L_R,G,B from the timing controller 8 are not extensionally converted.

This is identical to a case when the back light 12 is turned on by 100% without data conversion like in the related art. In the case, a color temperature characteristic as shown in FIG. 3B is shown. In detail, in a section between a 0 gray scale 0 Gray level which is a lowest gray scale level and a 186 gray scale 186 Gray level which is set as the first reference gray scale level, the graph has a very moderate slope, showing almost no color temperature difference. In this instance, though a sharp color temperature difference is shown below about 40 gray scale 40 Gray level, this is a negligible slope of change because this is a color temperature change in a dark state which is difficult to identify with naked eyes. Opposite to this, within ranges which can be recognized with the naked eyes, only in a range between the first reference gray scale level G1 and 239 gray scale 239 Gray level which is set as the second reference gray scale level G2 and in a range between the second reference gray scale level G2 and 255 gray scale 255 Gray level which is the greatest gray scale level, small changes are sensed.

Figure 4A:
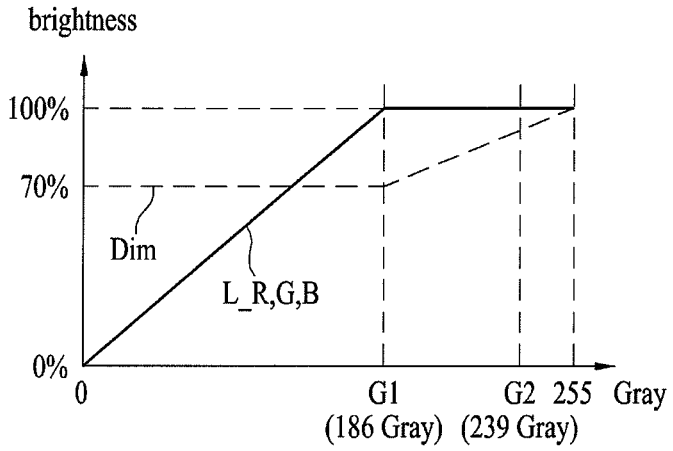
FIG. 4A illustrates a graph showing a relation between a picture data having an extended gray scale and a dimming control signal having a varied duty ratio in accordance with a first preferred embodiment of the present invention.
Figure 4B:
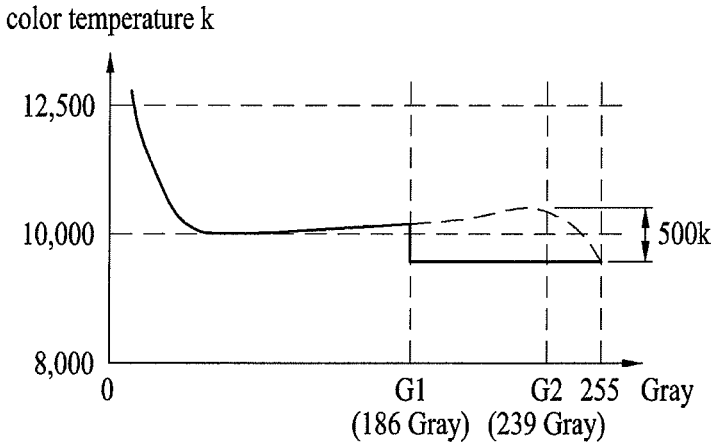
FIG. 4B illustrates a graph showing a color temperature change according to the extended picture data and the varied dimming control signal in FIG. 4A.

FIG. 4A illustrates graph showing a relation between a picture data having an extensionally changed gray scale and a dimming control signal having a varied duty ratio in accordance with a first preferred embodiment of the present invention, and FIG. 4B illustrates a graph showing a color temperature change according to the extensionally changed picture data and the varied dimming control signal in FIG. 4A.

FIG. 4A illustrates an example in which a conversion ratio is set such that the greatest gray scale values of the picture data L_R,G,B received within the range from the smallest gray scale level 0 Gray to the 186 gray scale 186 Gray which is set as the first reference gray scale level G1 are the first reference gray scale level G1, and the gray scale values of the picture data L_R,G,B in a range greater than the first reference gray scale level G1 are set to be changed to the greatest gray scale level 255 Gray in package. FIG. 4A illustrates an example in which the dimming control signal Dim is set to maintain the duty ratio smaller than the 100% duty ratio in a case the detected gray scale information BCS is within a range of the smallest gray scale level to the first reference gray scale level, and the dimming control signal Dim is set to increase to 100% at the maximum gradually in a case the detected gray scale information BCS is greater than the first reference gray scale level G1.

That is, the gray scale modulation unit 28 sets the conversion ratio such that the first reference gray scale level G1 is the greatest gray scale values in a case the gray scale values of the picture data L_R,G,B received from the timing controller 8 are within a range of the smallest gray scale level 0 Gray to the first reference gray scale level G1 and sets such that the gray scale values of the picture data L_R,G,B are converted into the greatest gray scale values 255 Gray in package in a case the gray scale values of the picture data L_R,G,B received from the timing controller 8 are greater than the first reference gray scale level G1, thereby enabling to extensionally converting the aligned picture data L_R,G,B.

In this instance, the dimming control unit 26 can generate the dimming control signal Dim such that the duty ratio is maintained to be smaller than the 100% duty ratio in a case the gray scale information BCS detected at the gray scale analyzing unit 24 is below the first reference gray scale level G1, and the duty ratio increases up to the 100% duty ratio at the maximum gradually in a case the gray scale information BCS is greater than the first reference gray scale level G1.

As described, in a case the liquid crystal display device is driven by extensionally converting the picture data L_R,G,B and varying and forwarding the dimming control signal in accordance with a first preferred embodiment of the present invention, a driving time period of the back light 12 can be reduced while the brightness of the displayed picture is improved, enabling to save power consumption.

However, in a case the liquid crystal display device is driven in accordance with the first preferred embodiment of the present invention, a problem takes place as shown in FIG. 4B, too. In detail, since the gray scale values of the picture data L_R,G,B are changed to the greatest gray scale values in package if the gray scale values of the picture data L_R,G,B are greater than the first reference gray scale level G1, though the brightness of the picture data L_R,G,B can be improved, the color temperature is changed causing the color temperature distorted from an original picture by about 500K as shown in FIG. 4B. If the color temperature has a great range of distortion within a gray scale range such that the user can recognize the distortion with naked eyes, displaying as if a chromaticity of the original picture is distorted, a picture quality of the display picture can become poor.

Figure 5A:
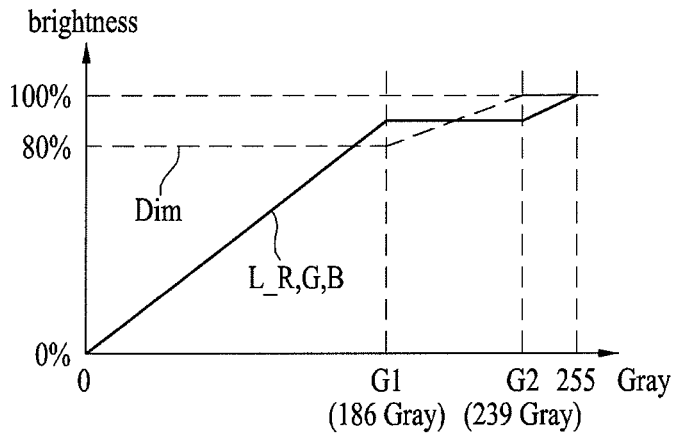
FIG. 5A illustrates a graph showing a relation between a picture data having an extensionally converted gray scale and a dimming control signal having a varied duty ratio in accordance with a second preferred embodiment of the present invention.
Figure 5B:
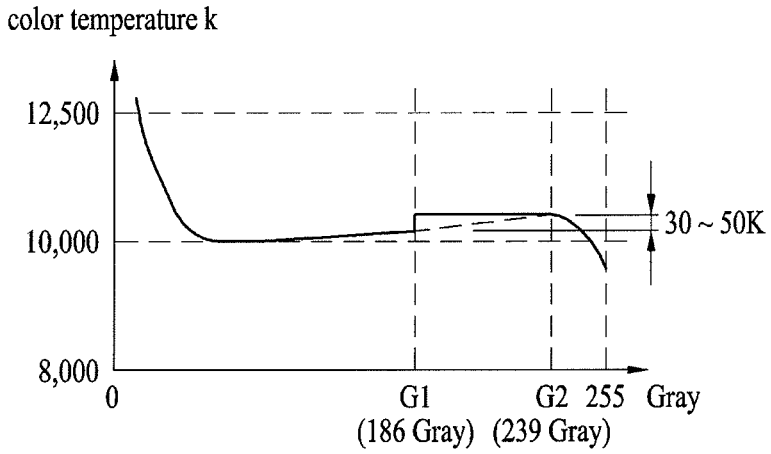
FIG. 5B illustrates a graph showing a color temperature change according to the extensionally converted picture data and the varied dimming control signal in FIG. 5A.

FIG. 5A illustrates a graph showing a relation between a picture data having an extensionally converted gray scale and a dimming control signal having a varied duty ratio in accordance with a second preferred embodiment of the present invention, and FIG. 5B illustrates a graph showing a color temperature change according to the extensionally converted picture data and the varied dimming control signal in FIG. 5A.

FIG. 5A illustrates an example in which a conversion ratio is set such that the greatest gray scale values of the picture data L_R,G,B received within the range from the smallest gray scale level 0 Gray to the 186 gray scale 186 Gray which is set as the first reference gray scale level G1 are the first reference gray scale level G1 which is set smaller than the greatest gray scale 255 Gray level, all of the gray scale values of the picture data L_R,G,B received in a range greater than the first reference gray scale level G1 to a range smaller than the second reference gray scale level G2 are set to be changed to a level the same with the first reference gray scale level G1, and the conversion ratio is set such that the greatest gray scale values of the picture data L_R,G,B received in a range of the second reference gray scale level G2 to the greatest gray scale level 255 Gray are the greatest gray scale level 255 Gray.

FIG. 5A illustrates also an example in which the dimming control signal Dim is set to maintain a first duty ratio (for an example, 80%) smaller than the 100% duty ratio in a case the detected gray scale information BCS is within a range of the smallest gray scale level 0 Gray to the first reference gray scale level, the dimming control signal Dim is set to increase the duty ratio gradually in a case the detected gray scale information BCS is greater than the first reference gray scale level G1 and smaller than the second reference gray scale level G2, and the dimming control signal Dim is set to be fixed at the 100% duty ratio at the maximum in a case the detected gray scale information BCS is in a range greater than the second reference gray scale level G2 to the greatest gray scale level 255 Gray.

In other words, the gray scale modulation unit 28 in accordance with the second preferred embodiment of the present invention sets the conversion ratio such that the greatest gray scale value of the gray scale values of the aligned picture data L_R,G,B received from the timing controller 8 is the first reference gray scale level G1 which is set smaller than the greatest gray scale 255 Gray level if the gray scale values of the aligned picture data L_R,G,B is within a range from the smallest gray scale 0 Gray to the first reference gray scale level G1, sets the conversion ratio such that all of the gray scale values of the aligned picture data L_R,G,B received from the timing controller 8 is a level identical to the first reference gray scale level G1 if the gray scale values of the aligned picture data L_R,G,B are within a range greater than the first reference gray scale level G1 to a range smaller than the second reference gray scale level G2, and sets the conversion ratio such that the greatest gray scale value of the gray scale values of the aligned picture data L_R,G,B received from the timing controller 8 is the greatest gray scale level 255 Gray if the gray scale values of the aligned picture data L_R,G,B are within a range greater than the second reference gray scale level G2 to the greatest gray scale level 255 Gray.

In this instance, the dimming control unit 26 generates the dimming control signal Dim such that a first duty ratio (for an example, 80%) which is smaller than the 100% duty ratio is maintained if the gray scale information BCS detected at the gray scale analyzing unit 24 is within a range of the smallest gray scale level 0 Gray to the first reference gray scale level G1, the duty ratio increases gradually up to 100% duty ratio at the maximum if the gray scale information BCS detected at the gray scale analyzing unit 24 is within a range greater than the first reference gray scale level G1 and smaller than the second reference gray scale level G2, and the duty ratio is fixed at 100% duty ratio at the maximum if the gray scale information BCS detected at the gray scale analyzing unit 24 is within a range from the second reference gray scale level G2 to the greatest gray scale level 255 Gray.

As has been described, if the picture data L_R,G,B are extensionally converted to respective ranges and the duty ratio of the dimming control signal Dim are also forwarded varying ranges thereof differently in driving the liquid crystal display device, the color temperature change range can be maintained within 30 k~50 k while improving the brightness of the display picture. According to this, since the present invention can minimize the color temperature change while improving the brightness, a picture quality of the display picture can be improved. Moreover, the present invention can save a driving time period of the backlight 12 owing to the dimming control signal Dim of which duty ratio is varied, thereby permitting to reduce power consumption.

As has been described, the device and method for driving a liquid crystal display device have the following advantages.

While preventing defective picture display caused by the color temperature difference from taking place, brightness is improved and power consumption can be reduced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A device for driving a liquid crystal display device comprising:

a liquid crystal panel having a plurality pixel regions formed thereon;

gate and data drivers configured to drive gate and data lines on the liquid crystal panel;

a timing controller configured to align and forward external picture data suitable for driving the liquid crystal panel and controlling the gate and data drivers;

a picture converting unit configured to set a first and second reference gray scale level at which the color temperature characteristic of the picture data changes significantly, and change a duty ratio of a dimming control signal according to the first and second reference gray scale level;

a back light unit configured to direct a light to the liquid crystal panel in response to the dimming control signal, wherein the picture converting unit is further configured to forward the picture data having the set first and second reference gray scale level to the data driver, wherein the first and second reference gray scale levels are set to be gray scale levels at which the color temperature characteristic changes significantly respectively of entire gray scale levels of the picture data; and a dimming control unit configured to generate the dimming control signal the color temperature change can be made minimum by varying the duty ratio depending on whether the gray scale information detected from the timing controller falls on a gray scale range smaller than the first and second reference gray scale levels set, between the first and second reference gray scale levels set, or greater than the first and second reference gray scale levels set.

2. The device as claimed in claim 1, wherein the picture converting unit includes:

a gray scale analyzing unit configured to detect gray scale values of the aligned picture data in the first and second horizontal line or frame to detect gray scale information on at least one of the greatest, the smallest, the most frequent, or an average gray scale value, the dimming control unit configured to perform a first comparison of a range of reference gray scale levels set by the picture converting unit to the gray scale information detected by the gray scale analyzing unit, and change the duty ratio according to a result of the first comparison to generate the dimming control signal, and a gray scale modulation unit configured to perform a second comparison of the range of reference gray scale levels set by the picture converting unit to the aligned and forwarded picture data and, according to a result of the second comparison, set change widths of the gray scale values different from one another, or replace the gray scale values with preset gray scale values, for changing the gray scale values of the picture data to have extended widths the same or different from one another.

3. The device as claimed in claim 2, wherein the gray scale analyzing unit is further configured to detect the gray scale values of the aligned picture data in at least one horizontal line or frame, produce a histogram of the detected gray scale values in at least one horizontal line or frame, and detect the gray scale information on at least one of the greatest, the smallest, the most frequent, or the average gray scale from the histogram.

4. The device as claimed in claim 2, wherein the gray scale modulation is further configured to:

set a conversion ratio such that a first gray scale level set smaller than a greatest gray scale level is a greatest gray scale value of the gray scale values of the aligned picture data if the gray scale values of the aligned picture data are within a range of a smallest gray scale level to a first reference gray scale level in the reference gray scale levels, set the conversion ratio such that all of the gray scale values of the picture data are converted into a level identical to the first gray scale level when the gray scale values of the aligned picture data are within a range greater than the first reference gray scale level to smaller than the reference second gray scale level, and set the conversion ratio such that the greatest gray scale level becomes the greatest gray scale value of the aligned picture data if the gray scale values of the aligned picture data are within a range of the second reference gray scale level to the greatest gray scale level.

5. The device as claimed in claim 4, wherein the dimming control unit generates the dimming control signal such that a first duty ratio which is smaller than the 100% duty ratio is maintained when the gray scale information is within a range of the smallest gray scale level to the first reference gray scale level, the duty ratio increases gradually up to 100% duty ratio at the maximum when the gray scale information is within a range greater than the first reference gray scale level and smaller than the second reference gray scale level, and the duty ratio is fixed at 100% duty ratio at the maximum when the gray scale information is within a range from the second reference gray scale level to the greatest gray scale level.

6. A method for driving a liquid crystal display device having gate and data drivers for driving gate and the data lines on a liquid crystal panel and a timing controller for aligning and forwarding external picture data suitable for driving the liquid crystal panel, comprising:

setting a first and second reference gray scale level at which a color temperature characteristic of the picture data changes significantly, and changing a duty ratio of a dimming control signal according to the first and second reference gray scale level;

changing gray scale values of the aligned picture data and forwarding the picture data having the changed gray scale values to the data driver; and directing a light to the liquid crystal panel in response to the dimming control signal, wherein the first and second reference gray scale levels are set to be gray scale levels at which the color temperature characteristic changes significantly respectively of entire gray scale levels of the picture data, and wherein changing the duty ratio of the dimming control signal the color temperature change is made minimum by varying the duty ratio depending on whether the gray scale information detected from the timing controller falls on a gray scale range smaller than the first and second reference gray scale levels set, between the first and second reference gray scale levels set, or greater than the first and second reference gray scale levels set.

7. The method as claimed in claim 6, wherein the generating the dimming control signal and changing gray scale values of the aligned picture data includes:

detecting the gray scale values of the aligned picture data in the first and second horizontal line or frame to detect gray scale information on at least one of the greatest, the smallest, the most frequent, or an average gray scale value, comparing a range of the gray scale set by the reference gray scale levels to the detected gray scale information, and changing the duty ratio according to a result of the comparison to generate the dimming control signal, and comparing the gray scale range of the set reference gray scale levels to the aligned and forwarded picture data, according to a result of the comparison, setting change widths of the gray scale values different from one another, or replacing the gray scale values with preset gray scale values, for changing the gray scale values of the picture data to have extended widths the same or different from one another.

8. The method as claimed in claim 7, wherein the changing gray scale values of the aligned picture data includes:

setting a conversion ratio such that a first gray scale level set smaller than a greatest gray scale level is a greatest gray scale value of the gray scale values of the aligned picture data when the gray scale values of the aligned picture data are within a range of a smallest gray scale level to a first reference gray scale level in the reference gray scale levels, setting the conversion ratio such that all of the gray scale values of the picture data are converted into a level identical to the first gray scale level when the gray scale values of the aligned picture data are within a range greater than the first reference gray scale level to smaller than the reference second gray scale level, and setting the conversion ratio such that the greatest gray scale level becomes the greatest gray scale value of the aligned picture data when the gray scale values of the aligned picture data are within a range of the second reference gray scale level to the greatest gray scale level.

9. The method as claimed in claim 8, wherein the producing the dimming control signal includes:

generating the dimming control signal such that a first duty ratio which is smaller than the 100% duty ratio is maintained when the gray scale information is within a range of the smallest gray scale level to the first reference gray scale level, the duty ratio increases gradually up to 100% duty ratio at the maximum when the gray scale information is within a range greater than the first reference gray scale level and smaller than the second reference gray scale level, and the duty ratio is fixed at 100% duty ratio at the maximum when the gray scale information is within a range from the second reference gray scale level to the greatest gray scale level.

10. The method as claimed in claim 6, wherein the detecting gray scale information includes:

detecting the gray values of the aligned picture data in at least one horizontal line or frame, producing a histogram of the gray values detected in at least one horizontal line or frame, and detecting the gray scale information on at least one of the greatest, the smallest, the most frequent, or the average gray scale from the histogram.

* * * * *